US005196642A

United States Patent [19]

Tripp

[11] Patent Number: 5,196,642

[45] Date of Patent: Mar. 23, 1993

[54] UNBALANCE-COMPENSATING DEVICE FOR A WEAPON, ESPECIALLY A LARGE-CALIBER WEAPON WITH A LONG BARREL

[75] Inventor: Ernst Tripp, Vellmar, Fed. Rep. of Germany

[73] Assignee: Firma Wegmann & Co. GmbH, Kassel, Fed. Rep. of Germany

[21] Appl. No.: 815,984

[22] Filed: Jan. 2, 1992

[30] Foreign Application Priority Data

Jan. 4, 1991 [DE] Fed. Rep. of Germany ..... 4100102

[51] Int. Cl.[5] ..... F41A 27/30

[52] U.S. Cl. ..... 89/37.08

[58] Field of Search ..... 89/37.08, 39

[56] References Cited

U.S. PATENT DOCUMENTS 3,033,085 5/1962 Witkin ..... 89/37.08

FOREIGN PATENT DOCUMENTS 1097319 1/1961 Fed. Rep. of Germany .
3732745 6/1989 Fed. Rep. of Germany .
3633375 5/1990 Fed. Rep. of Germany .
731422 9/1932 France ..... 89/37.08
179346 5/1962 Sweden ..... 89/37.08

*Primary Examiner*—Stephen C. Bentley
*Attorney, Agent, or Firm*—Sprung Horn Kramer & Woods

[57] ABSTRACT

An unbalance-compensating device for a weapon, especially a large-caliber weapon with a long barrel, with a component accommodating the barrel, mounted on trunnions in a stationary accommodation, and pivoting in elevation. The pivoting component's center of gravity is outside the trunnions' axis of rotation. A torque that counteracts the moment of unbalance is generated in that the weapon's pivoting component is attached by a flexible tractioning component to a device on the stationary accommodation that produces a positioning force. The tractioning component travels along a contour of prescribed shape attached to the weapon's pivoting component and determining the effective component of lifting force. The device is light in weight, takes up little space in the vicinity of the angle of elevation, and provides almost perfect compensation for the moment of unbalance while also allowing for temperature compensation. The device that generates the positioning force has a pneumatic cylinder with a piston rod attached to the flexible tractioning component and with its interior communicating with a compression reservoir.

2 Claims, 3 Drawing Sheets

I (WEAPON UNBALANCE)
II
(MOMENT OF COMPENSATION)
M
x10³ Nm
60
50
40
30
25
-25 0
10
20
30
40
50
60
65
α [°]

α=-25°
α=65°
5

UNBALANCE-COMPENSATING DEVICE FOR A WEAPON, ESPECIALLY A LARGE-CALIBER WEAPON WITH A LONG BARREL

BACKGROUND OF THE INVENTION

The invention concerns an unbalance-compensating device for a weapon, especially a large-caliber weapon with a long barrel, with a component accommodating the barrel, mounted on trunnions in a stationary accommodation, and pivoting in elevation, whereby the pivoting component's center of gravity is outside the trunnions' axis of rotation, wherein a torque that counteracts the moment of unbalance is generated in that the weapon's pivoting component is attached by a flexible tractioning component to a device on the stationary accommodation that produces a positioning force, and wherein the tractioning component travels along a contour of prescribed shape attached to the weapon's pivoting component and determines the effective component of lifting force.

An unbalance-compensating device of this type is described in German AS 1 097 319 for example. The flexible tractioning component is a roller chain and the contour that determines the effective component of lifting force has teeth. The device that generates the positioning force is a tension spring connected at one end to the tractioning component and at the other to the stationary accommodation.

A similar unbalance-compensating device is described in German Patent 3 633 375. The device that generates the positioning force is either a spring or a system of springs. Means for displacing the springs' point of engagement to the stationary accommodation operate in conjunction with circuitry that takes the angle of the stationary accommodation into consideration when compensating for the unbalance.

It has been demonstrated that the springs in unbalance-compensating devices that employ springs or spring systems are heavy and stretch far enough, especially at high elevations, to take up a lot of space.

Unbalance-compensating devices that compensate for moments of unbalance with pneumatic cylinders are also known. The cylinders articulate in the case of a tank for example far forward of the trunnions' axis of rotation and are accordingly unprotected by the turret.

Converting the moment of unbalance into pressure that operates in a hydro-pneumatic reservoir is also known.

German OS 3 732 745 describes an unbalance-compensating device with a pneumatic cylinder communicating with a mechanism that compensates for temperature-dictated changes in the pressure of the gas. This mechanism communicates with a regulator connected to a source of compressed gas. A mechanism of this type can compensate for temperature-dictated changes in the torque that counteracts the moment of unbalance.

The articulation kinematics of such devices is embodied in a crank mechanism on the pivoting component of the weapon and leaves extensive residual unbalances that must be applied by the elevating gear or by a manually operated mechanism.

SUMMARY OF THE INVENTION

The object of the present invention is accordingly an improved unbalance-compensating device with the aforesaid characteristics that will be light in weight, take up little space in the vicinity of the angle of elevation, and provide almost perfect compensation for the moment of unbalance while also allowing for temperature compensation.

This object is attained in accordance with the invention in that the device that generates the positioning force has a pneumatic cylinder with a piston rod attached to the flexible tractioning component and with its interior communicating with a compression reservoir.

The point of departure for the invention is an unbalance-compensating device with a flexible tractioning component traveling over a contour that determines the effective component of lifting force, allowing satisfactory adjustment of the moment of compensation to the moment of unbalance. The device that generates the positioning force, however, is a pneumatic cylinder and compression reservoir instead of a spring or system of springs.

It has been demonstrated that this approach will allow considerable reductions in weight and size. One particularly advantageous embodiment of an unbalance-compensating device in accordance with the invention allows temperature compensation of the moment of compensation with extremely simple means in the form of an additional compression reservoir that compensates for the decrease in pressure at low temperatures and of valves that automatically compensate for the increased pressure that occurs as the temperature rises such that the operating pressure of the pneumatic cylinder remains constant over the whole range of temperature.

The unbalance-compensating device in accordance with the invention is especially intended for heavy and large-caliber weapons although is in no way restricted to that application. The device can also be employed to great advantage to decrease the effort of elevation in medium-heavy and light-weight weapons that are elevated manually.

The stationary accommodation for the pivoting component of the weapon and the barrel can be either a gun carriage or the turret of an armored howitzer or tank.

Depending on the dimension of unbalance and on the available space, one or more unbalance-compensating devices in accordance with the invention can be used with one weapon.

Embodiments of an unbalance-compensating device in accordance with the invention will now be described by way of example with reference to the drawings, wherein

DETAILED DESCRIPTION OF THE INVENTION

Figure 1:
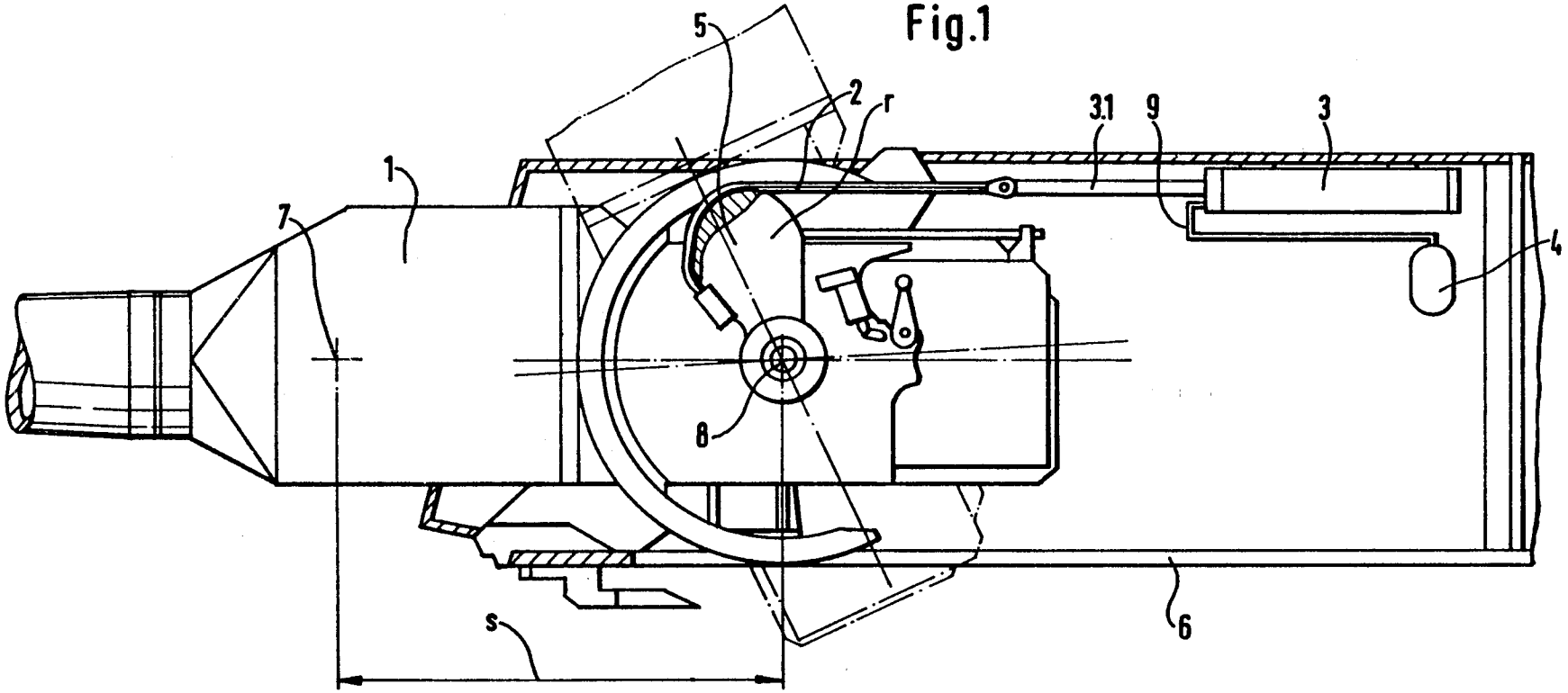
FIG. 1 is a side view of a weapon mounted in the turret of military tank with an unbalance-compensating device.

FIG. 1 is a highly schematic representation of a weapons system installed in the turret 6 of an otherwise unillustrated tank. The system includes a pivoting component 1 comprising a barrel and cradle elevating on trunnions 8 in a stationary accommodation in the form of turret 6 in response to unillustrated controls of a known type. An unbalance-compensating device comprises a pneumatic cylinder 3 on the roof of the turret. Its piston rod 3.1 is fastened to a flexible tractioning component, a wire cable 2 for example, the other end of which is fastened to the weapon's pivoting component 1 and extends over a cam 5 attached to that component. Since the cable extends over the cam, a prescribed effective component r of lifting force is associated with each elevation of the pivoting component of the weapon, corresponding with the particular distance of the point where cable 2 engages cam 5 from the axis of rotation of trunnions 8. The contour on cam 5 will be discussed hereinafter.

The interior of pneumatic cylinder 3 communicates with a compression reservoir 4 by way of a line 9. The pneumatics will be described hereinafter with reference to FIGS. 2 and 3.

FIG. 1 illustrates the position of the weapon's pivoting component 1 at specifically 0 and, in dot-and-dash lines, at a higher elevation.

Figure 2:
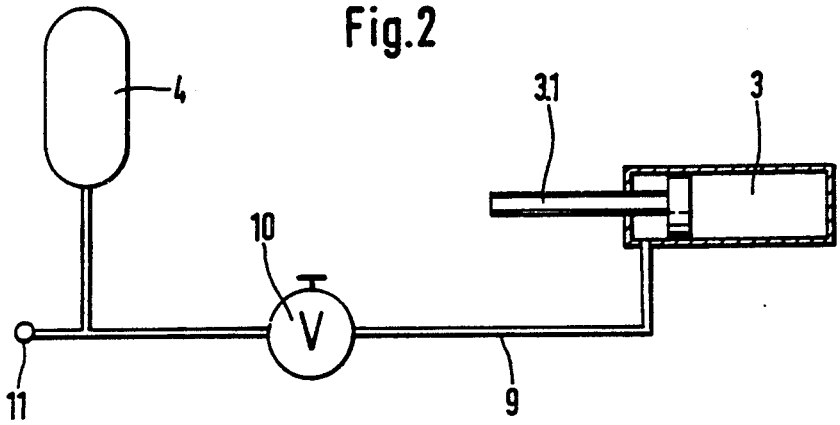
FIG. 2 is a flow chart illustrating the pneumatics of the unbalance-compensating device illustrated in FIG. 1.

FIG. 2 illustrates the pneumatics of an embodiment of the unbalance-compensating device in FIG. 1 without temperature compensation. Pneumatic cylinder 3 communicates with compression reservoir 4 by way of a line that contains a manually operated valve 10. Compression reservoir 4 also communicates with a connection 11 for gauging the level of fluid and adding more. Valve 10 closes the system for maintenance and inspection.

Figure 3:
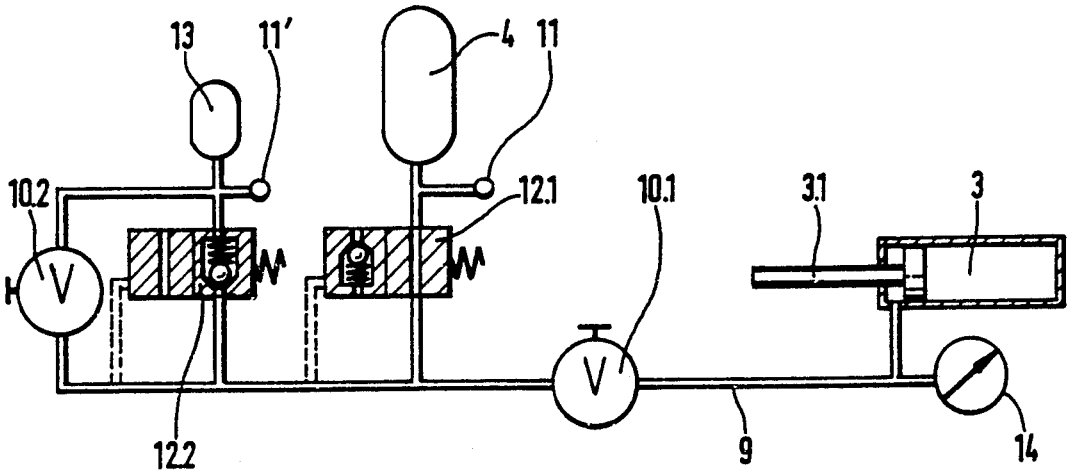
FIG. 3 is a flow chart similar to that in FIG. 2 and illustrating another embodiment of the pneumatics employed in the unbalance-compensating device illustrated in FIG. 1.

The pneumatics illustrated in FIG. 3 allow temperature compensation. Parts identical with those in FIG. 2 are labeled with the same reference numbers.

A compression reservoir 4 with a connection 11 for gauging the level of fluid and adding more, communicates through a control valve 12.1 and line 9, which includes a manually operated valve 10.1, with the interior of pneumatic cylinder 3. Another compression reservoir 13 parallels compression reservoir 4, communicates with line 9 through another control valve 12.2 and, has a connection 11' for gauging and adding fluid. Another manually operated valve 10.2 parallels second control valve 12.2. The pressure in line 9 is verified with a gauge 14. Control valves 12.1 and 12.2 are activated in accordance with the level of pressure in line 9. The initial pressure in second compression reservoir 13 is higher than the initial pressure in first compression reservoir 4. In its closed state, first control valve 12.1 functions as a check valve that prevents fluid from traveling toward first compression reservoir 4. Second control valve 12.2 also has a closed state, in which it prevents fluid from traveling toward pneumatic cylinder 3 or line 9. When gauge 14 detects a decrease in pressure due to a decrease in temperature, second manually operated valve 10.2 can be opened to briefly engage second compression reservoir 13 and restore the pressure to its ideal level. The pressure can be monitored at gauge 14. Second manually operated valve 10.2 will close again as soon as the ideal pressure is established.

Control valves 12.1 and 12.2 engage automatically as soon as the system heats up to above the normal range of temperature. When the pressure increases in line 9 beyond a prescribed threshold, first control valve 12.1 closes and blocks access to first compression reservoir 4. Second control valve 12.2 simultaneously opens, allowing second compression reservoir 13 to accommodate the excess pressure. Fluid enters reservoirs 4 and 13 whenever the barrel is lowered and pneumatic cylinder 3 is activated. When the barrel is raised, the pressure in line 9 decreases again, closing second control valve 12.2 and opening first control valve 12.1. The system will then continue to operate in the normal-temperature range, communicating with first compression reservoir 4.

How the performance of the unbalance-compensating device can be affected by the shape of the contour on cam 5 will now be explained with reference to FIGS. 4 and 5.

In accordance with known relationships, $$M_u = gGs \cos \alpha$$

wherein $M_u$ is the moment of unbalance,
g is the acceleration due to gravity,
G is the weight of the weapon,
s is the distance of the weapon's center 7 of gravity from the axis of rotation of trunnions 8, and
$\alpha$ is the elevation.

For the moment $M_A$ of compensation, $$M_A = rpA$$

wherein r is the effective component of lifting force at cam 5,
p is the effective pressure, and
A is the effective area of the piston.

For complete compensation, $$M_u(\alpha) = M_A(\alpha)$$

whereby both moments are interpreted as functions of the angle of elevation.

For the effective component r of lifting force and hence the particular distance of a point on cam 5 from the axis of rotation of trunnions 8 accordingly, $$r(\alpha) = \frac{gGs \cos \alpha}{pA}.$$

The following table lists values of r at various elevations calculated from the foregoing equation for a concrete example with two identical unbalance-compensating devices on the same weapon. The contour of the cam can be derived from these values and smoothed out as illustrated in FIG. 5.

| | | | | | | | | | |
|---|---|---|---|---|---|---|---|---|---|
| r [mm]: | 475 | 480 | 500 | 510 | 510 | 483 | 430 | 350 | 300 |
| $\alpha$ [°]: | −2.5 | 0 | 10 | 20 | 30 | 40 | 50 | 60 | 65 |

Figures 4, 5:
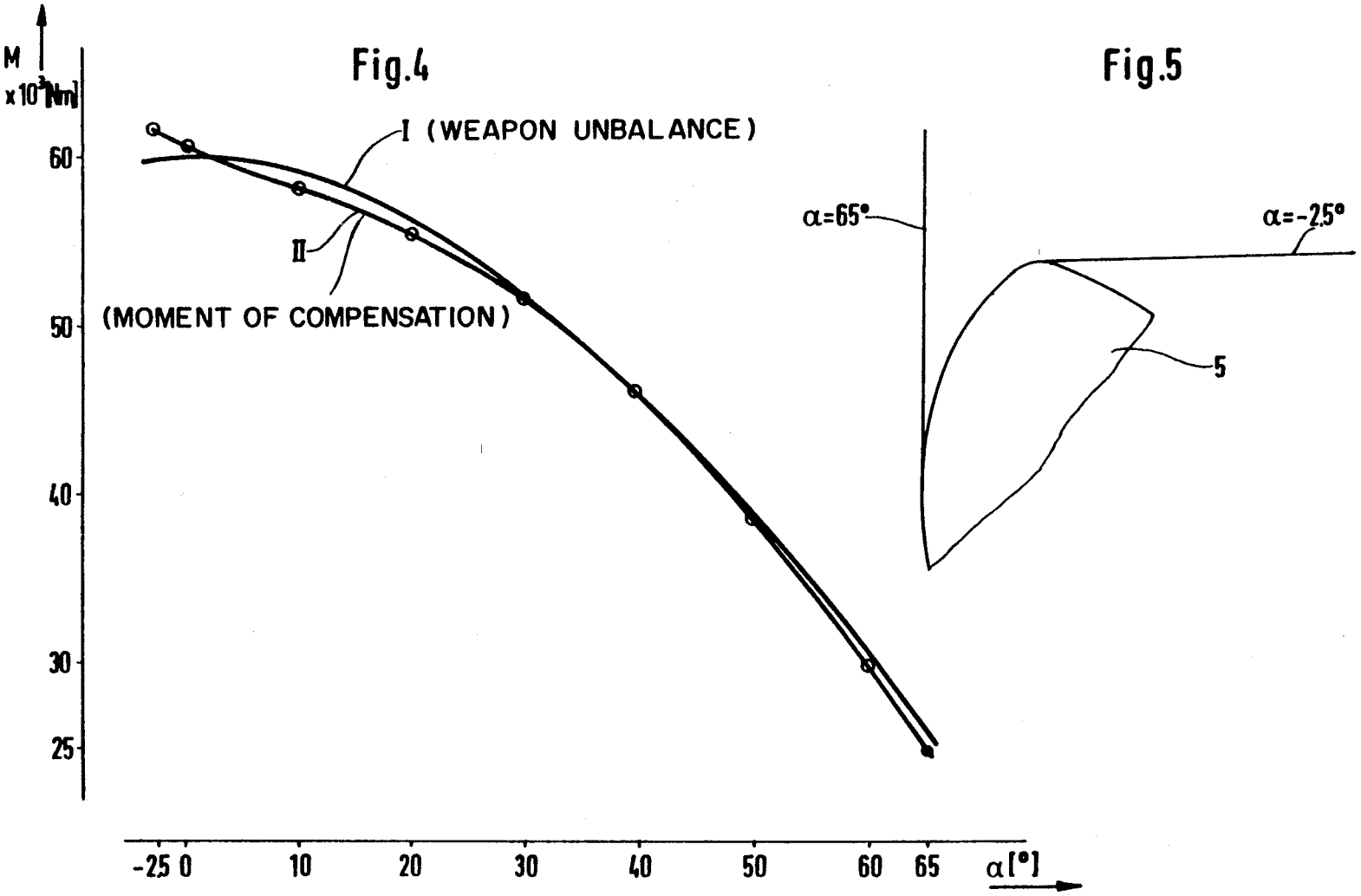
FIG. 4 is a graph plotting the weapon's unbalance and moment of compensation.
FIG. 5 illustrates part of a possible contour for an unbalance-compensating device of the type illustrated in FIGS. 2 through 3.

The curve I in FIG. 4 represents the weapon's moment of unbalance and curve II the counteracting torque of the unbalance-compensating device for an angle $\alpha$ of elevation. The moment of unbalance is a cosine function, and it will be evident from the figure that the counteracting torque fits it very satisfactorily over a wide range of elevations, with only slight deviations that must be compensated for by the elevating mechanism.

The unbalance-compensating device has many advantages.

The device can be installed and removed with the weapon in its lowermost or lashed-down position because the compression reservoirs can be installed such that they can be disengaged or the system can be depressurized.

The individual components are small and light in weight. The system can accordingly easily be installed behind the armor plate in the turret.

Using two identical unbalance-compensating devices will result in redundance from the security aspect with positive effects on the elevating mechanism, specifically a reduction by one half of both the retaining moment and of the fractional forces on the elevating mechanism.

The elevating mechanism will require only a small overall transmission, the elevating mechanism can be light in weight, elevation will be easier and more rapid and only a little effort will be needed for manual elevation.

What is claimed is:

1. An unbalance-compensating device for a weapon, comprising: a stationary accommodation, trunnions in the stationary accommodation, a pivoting component pivotable about an axis of rotation on the trunnions and having a center of gravity outside the axis of rotation, means disposed on the stationary accommodation for producing a positioning force, a flexible tractioning member containing the pivoting component to the means for producing the positioning force to produce a torque that counteracts a moment of unbalance, means defining a contour of a prescribed shape attached to the pivoting component, wherein the tractioning member travels along the contour to determine an effective component of lifting force and wherein the means for producing the positioning force comprises a pneumatic cylinder with a first compression reservoir and a piston rod attached to the flexible tractioning member and having an interior in communication with the first compression reservoir, a manually operated valve, a second compression reservoir pressurized higher than the first compression reservoir and in communication with the interior of the pneumatic cylinder via the manually operated valve, a first control valve providing communication between the first compression reservoir and the pneumatic cylinder, wherein the first control valve opens and closes to block access to the first compression reservoir, a second control valve providing communication between the second compression reservoir and the pneumatic cylinder, wherein the second control valve opens and closes to block access to the pneumatic cylinder, and means for activating the first and second control valves in response to pressure on the pneumatic cylinder such that when the manually operated valve is closed and the pressure is below a prescribed threshold, the first control valve is in the open state and the second control valve is in the closed state and when the threshold is exceeded the first control valve is shifted into the closed state and the second control valve into the open state.

2. The device as in claim 1, wherein the flexible tractioning member comprises a steel cable.

* * * * *